US005434921A

United States Patent [19]

Dombrowski, Jr. et al.

[11] Patent Number: 5,434,921

[45] Date of Patent: Jul. 18, 1995

[54] STEREO IMAGE CONTROL CIRCUIT

[75] Inventors: Joseph J. Dombrowski, Jr., Hollywood; Borislav L. Orozov, Boca Raton, both of Fla.

[73] Assignee: Sony Electronics Inc., Park Ridge, N.J.

[21] Appl. No.: 202,029

[22] Filed: Feb. 25, 1994

[51] Int. Cl.[6] ..... H04S 1/00

[52] U.S. Cl. ..... 381/1

[58] Field of Search ..... 381/1, 103

[56] References Cited

U.S. PATENT DOCUMENTS

| | | | |
|---|---|---|---|
| 3,170,991 | 2/1965 | Glasgal | 381/1 |
| 3,222,455 | 12/1965 | Golik | 381/28 |
| 3,755,749 | 8/1973 | Van Ryswyk et al. | 381/103 |
| 4,149,036 | 4/1979 | Okamoto et al. | 381/1 |
| 4,192,969 | 3/1980 | Iwahara | 381/1 |

OTHER PUBLICATIONS

Description of "Classic" unit sold by AMEK (undated).
Description of "BC III" unit sold by AMEK (undated).
Description of "Mats" Unit sold by Neve (undated).
Description of "SL5000M" unit sold by Solid State Logic (undated).

*Primary Examiner*—Forester W. Isen
*Attorney, Agent, or Firm*—Ronald P. Kananen

[57] ABSTRACT

A stereo imaging circuit has a first channel input terminal, and a second channel input terminal; a variable resistance in circuit with each of the first and the second channel input terminals; a first amplifier in the first channel in circuit with the variable resistance, an output of the first amplifier in the first channel providing an input to a second amplifier in the first channel, an output of the second amplifier in said first channel providing an output of the first channel to a first channel output terminal; a first amplifier in the second channel in circuit with said variable resistance, an output of said first amplifier in said second channel providing an input to a second amplifier in the second channel, an output of the second amplifier in the second channel providing an output of the second channel to a second channel output terminal; a first interchannel amplifier having a variable transfer ratio and having an input in circuit with the first channel and an output in circuit with the second channel; a second interchannel amplifier having a variable transfer ratio and having an input in circuit with the second channel and an output in circuit with the first channel; the variable transfer ratio of the first and the second interchannel amplifiers being responsive to said variable resistance, whereby a stereo image circuit is provided which ranges between a MONO mode through a STEREO mode to a WIDE mode.

13 Claims, 2 Drawing Sheets

$$K_L = K_R = K_1 \cdot K_2(1-K_3)$$

$$K_1 \leq 1$$

$$1 \leq K_2$$

$$-1 \leq K_3 < 1$$

$K_L$
22
20
R
R
R
R
R
39
$K_R$
32
30
R
R
R
$R_H + R_L = R_P$
10
12
14
$R_C$
CW
$R_H$
$R_L$
R
34
36
$R_D$
R
$(K_2-1)R$
18
28
$R_A$
CW
14
$R_B$
38
16
L
26
R

STEREO IMAGE CONTROL CIRCUIT

BACKGROUND OF THE INVENTION

This invention relates to a stereo image control circuit. More particularly, this invention relates to a stereo image control circuit which varies the stereo image of an audio program by widening the stereo base in a two-channel audio system. Still more particularly, this invention relates to a circuit which provides flexibility in stereo imaging by controlling a base between both channels of a stereo audio program by smoothly changing the stereo base from a "0" mono-mode via a "stereo" mode to a larger dimension, providing a deeper and more spacious imaging effect.

In the prior art, most of the existing stereo imaging circuits address partly the problem of changing the stereo base either from a MONO mode to a STEREO mode or from a STEREO mode to a WIDE mode. Such circuits are used in portable audio products and some professional effect units. For example, in AMEK's BCIII unit, a stereo image control is provided with associated circuity to vary the stereo image width from normal stereo through mono to left/right reversed stereo. In Neve's MATS (monitoring and talkback system), a stereo width control is provided with a switch so that one of the stereo auxiliary busses becomes a stereo mix bus for a second line input. A unit from Solid State Logic SL5000 M Series includes a stereo programming panel for such width control.

However, such circuits were not entirely satisfactory because of a lack of flexibility in stereo imaging over the entire range and a desire to control the stereo base between both channels of the stereo audio program. It continued to be desirable to change the stereo base of such a circuit smoothly from a MONO mode via a STEREO mode to a larger dimension, thus providing a deeper and more spacious imaging effect because of an enhanced range. In addition, it is desired to implement the circuit in a way which provides larger control of the stereo image while determining the exact, necessary amount of control without affecting the gain.

These and other aims and objectives of the invention will become apparent from a review of the written description of the invention which follows taken in conjunction with the accompanying drawings.

BRIEF SUMMARY OF THE INVENTION

Directed to achieving the foregoing objectives and aims, a stereo imaging circuit according to the invention, in one of its main aspects, comprises a first channel input terminal, and a second channel input terminal; a variable resistance in circuit with each of the first and the second channel input terminals; a first amplifier in the first channel in circuit with the variable resistance, an output of the first amplifier in the first channel providing an input to a second amplifier in the first channel, an output of the second amplifier in the first channel providing an output of the first channel to a first channel output terminal; a first amplifier in the second channel in circuit with the variable resistance, an output of said first amplifier in the second channel providing an input to a second amplifier in the second channel, an output of the second amplifier in the second channel providing an output of the second channel to a second channel output terminal; a first interchannel amplifier having a variable transfer ratio and having an input in circuit with the first channel and an output in circuit with the second channel; a second interchannel amplifier having a variable transfer ratio and having an input in circuit with the second channel and an output in circuit with the first channel; the variable transfer ratio of the first and the second interchannel amplifiers being responsive to the variable resistance, whereby a stereo image circuit is provided which ranges between a MONO mode through a STEREO mode to a WIDE mode.

The circuit is also arranged so that the variable resistance is a potentiometer for controlling the MONO mode and the WIDE mode with the STEREO mode being determined by a position along the variable resistance determined by a manual setting. The transfer ratio of each of said first and said second channels of the circuit of the invention is $K_L=K_R=K_1 \cdot K_2(1-K_3)$ where $K_1$ is the transfer ratio of the variable resistance and $K_1 \leqq 1$; $K_2$ is the transfer ratio of each of the first amplifiers in each of the first and the second channels and $1 \leqq K_2$; and $K_3$ is the transfer ratio of each of the first and the second interchannel amplifiers, wherein $-1 \leqq K_3 < 1$.

The variable resistance in the first and the second channels is determined by a control potentiometer, the variable resistance being in circuit with each of the first and the second interchannel amplifiers. In a more specific embodiment, the variable resistance is in circuit with a non-inverting input of each of the first amplifiers in each of the first and second channels and in circuit between the output and the inverting input of each of the first and the second interchannel amplifiers. The variable transfer ratio of each of the interchannel amplifiers is determined at least in part by the variable resistance in a feedback relationship between an output and an input of each of the interchannel amplifiers.

In another more specific but important aspect of the invention, the variable resistance for continuously varying a stereo image from a MONO mode through a STEREO mode to a WIDE mode is in circuit with each of the first and the second channel input terminals, wherein the first amplifier in the first channel is in circuit with the variable resistance, a first amplifier in the second channel being in circuit with the variable resistance, an output of the second amplifier in the second channel providing an output of the second channel to a second channel output terminal; a first interchannel amplifier having a variable transfer ratio determined at least in part by the variable resistance and having an input in circuit with the first channel and an output in circuit with the second channel; a second interchannel amplifier having a variable transfer ratio determined at least in part by the variable resistance and having an input in circuit with the second channel and an output in circuit with the first channel; the variable transfer ratio of the first and the second interchannel amplifiers being responsive to the variable resistance, whereby a stereo image circuit is provided which ranges from a MONO mode through a STEREO mode to a WIDE mode.

Figure 1:
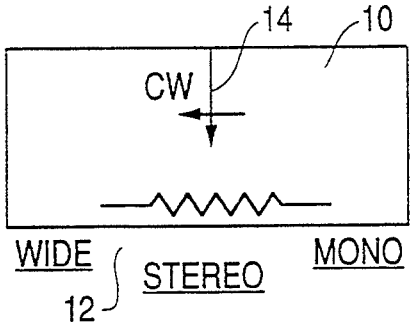
FIG. 1 is a representative stereo image control switch provided on a panel for a user to control the stereo image between a WIDE mode and a MONO mode.

DETAILED DESCRIPTION OF THE PREFERRED EMBODIMENTS:

In FIG. 1, a stereo mode switch is shown representatively by a reference numeral 10 as having a variable resistance 12 derived from a fixed resistance cooperating with a manually operable slider member 14 between a MONO mode and a WIDE mode in a clockwise direction denoted by an arrow CW. Such a switch 10 is included on a face of a control panel for the audio control system, whether consumer-directed or a professional audio system. The switch 10 cooperates with the stereo circuit shown representatively in FIG. 2.

Figure 2:
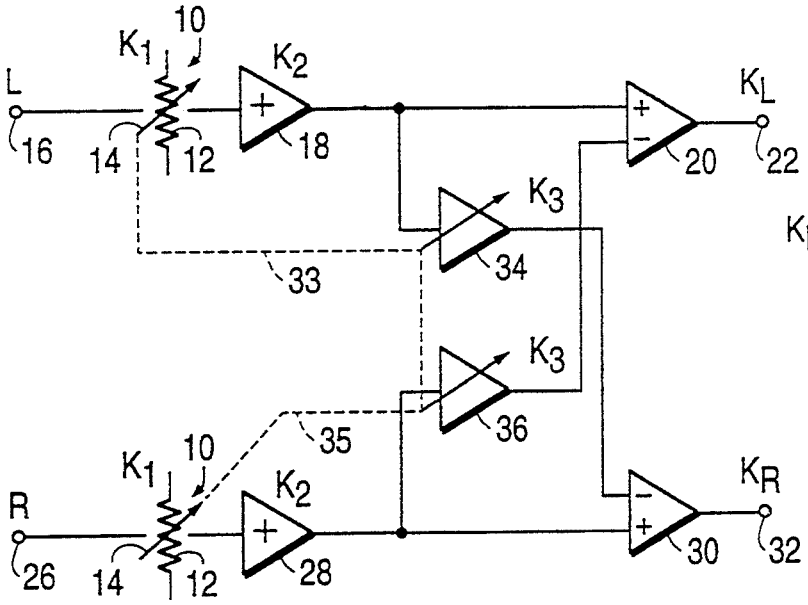
FIG. 2 is a diagrammatic circuit of the invention showing the effect of changing the switch of FIG. 1 on the ganged circuit of FIG. 2.

In FIG. 2, a left channel input L is provided at a left channel input terminal 16 which is connected to the slider 14 of a variable input resistance 12 together forming the switch 10 as seen in FIG. 1. The resistance 10 has a transfer ratio value $K_1$. The output from the manually variable resistance 12 is provided to an input of a first left channel amplifier 18 having a transfer ratio $K_2$. The output from the first left channel amplifier 18 is connected to a non-inverting input of a second left channel amplifier 20 having its output connected to a left channel output terminal $K_L$, designated with a reference numeral 22.

Similarly, a right channel input R is provided at a right channel input terminal 26 which is also connected to the slider 14 of the variable input resistance 12 together forming the switch 10 as seen in FIG. 1. The output from the manually variable resistance 12 is provided to the input of a first right channel amplifier 28 having a transfer ratio $K_2$. The output from the first right channel amplifier 28 is connected to a non-inverting input of a second right channel amplifer 30 having its output connected to a right channel output terminal designated with a reference numeral 32.

The transfer ratio of the circuit of FIG. 2, as seen from the output terminal 22 is $K_L$, while the transfer ratio as seen from the output terminal 32 is $K_R$. Preferably, $K_L = K_R$ for the assumptions shown.

A first interchannel amplifier 34 having a variable transfer ratio $K_3$ is connected between the output of the first left channel amplifier 18 and the inverting input of the second right channel amplifier 30. A second interchannel amplifier 36 having a like variable transfer ratio $K_3$ is connected between the output of the first right channel amplifier 28 and the inverting input of second left channel amplifier 20.

The inputs of each of the first and second interchannel amplifiers 34 and 36 are ganged with each other and with the manually variable control 14 of the input control resistor 10, as respectively indicated by the dotted lines 33 and 35. That is, the control depicted at reference numeral 10 in FIG. 1 commonly controls the transfer ratio of each of the amplifiers 18, 28, 34, and 36.

For the circuit shown in FIG. 2, the left and right transfer ratios are equal, as noted above, for signals of equal phase and given by the expression (1):

$$K_L = K_R = K_1 \cdot K_2 (1 - K_3) \quad (1)$$

where $K_1 \leqq 1$ and $1 \leqq K2$ and $-1 \leqq K_3 < 1$

Physically, it can be understood that the transfer ratio of the variable resistance 10 must be less than 1, and the gain of the first left channel amplifier 18 and the first right channel amplifier 28 is greater than unity. For these assumptions, if $K_3$ is 1, then the transfer ratio of each channel is 0 which clearly is undesirable for uniphase signals.

It is a feature of this circuit that the transfer ratio of the interchannel amplifiers ranges between $-1$ and $+1$, but is thus less than $+1$ so that the outputs for the respective channels are appropriately scaled.

Figure 3:
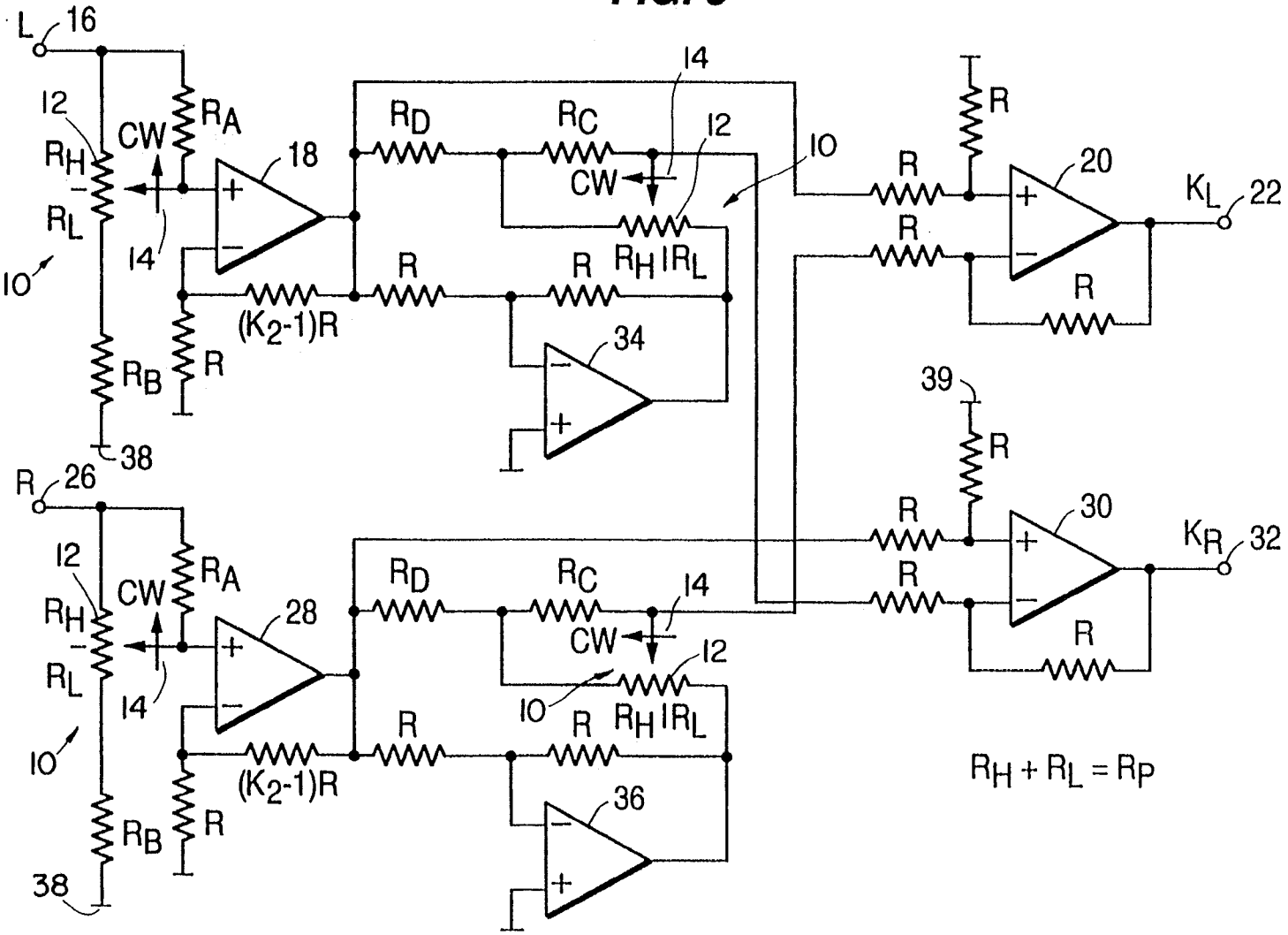
FIG. 3 is a preferred embodiment of the circuit shown diagrammatically in FIG. 2 using common OP AMP techniques.

The circuit of FIG. 3 is a practical, working embodiment of the diagrammatic circuit of FIG. 2. Accordingly, the same reference numerals are used in FIG. 3 as in FIGS. 1 and 2 to refer to like components. As can be seen, the resistance 12 of FIG. 1 has a value of $R_P$ which is the sum of $R_H$ and $R_L$. Thus, as seen in FIG. 3, the resistance 12 is in series with a resistor $R_B$ between the left channel input terminal 16 and a source of reference potential 38 such as ground. A like input circuit is provided for the right channel. Since the left channel circuitry and right channel circuitry are substantially identical, only the left channel will be discussed in detail along with a detailed discussion of the interchannel amplifiers.

The input to the left channel input terminal L at numeral 16 is provided through a resistance $R_A$ to the non-inverting terminal of the first left channel amplifier 18. The inverting terminal of the first left channel amplifier 18 is connected through a resistance R to a source of reference potential 38 and to the output of the amplifier 18 through a feedback resistance having a value $(K_2 - 1)$ R. The output of the first left channel amplifier 18 is also connected through a resistance R to the inverting input of the first interchannel amplifier 34 which has a resistance R connected in a feedback relationship between its output and its inverting input. The non-inverting input of the first interchannel amplifier 34 is connected to a source of reference potential.

The output of the amplifier 18 is also connected to the inverting input of the second right channel amplifier 30 through a series resistance having $R_D$, $R_C$, and R. The resistance $R_C$ is in parallel with the $R_H$ portion of the resistance 10 having its $R_L$ portion connected to the output of the first interchannel amplifier 34.

The output of the second left channel amplifier 30 is connected to its inverting input and to the left channel output terminal 22, while its non-inverting input is connected through a level-setting resistor R to a source of power.

The resistance 12 is in series with a resistor $R_B$ between the right channel input terminal 26 and a source of reference potential 38 such as ground. The input to the right channel input terminal R at numeral 26 is provided through a resistance $R_A$ to the non-inverting terminal of the first right channel amplifier 28. The inverting terminal of the first right channel amplifier 28 is connected through a resistance R to a source of reference potential 38 and to the output of the amplifier 28 through a feedback resistance having a value $(K_2 - 1)$ R. The output of the first right channel amplifier 28 is also connected through a resistance R to the inverting input of the second interchannel amplifier 36 which has a resistance R connected in a feedback relationship between its output and its inverting input. The non-inverting input of the second interchannel amplifier 36 is connected to a source of reference potential.

The output of the first right channel amplifier 28 is also connected to the inverting input of the second left channel amplifier 20 through a series resistance having $R_D$, $R_C$, and R. The resistance $R_C$ is in parallel with the $R_H$ portion of the resistance 10 having its $R_L$ portion connected to the output of the second interchannel amplifier 36.

The output of the second right channel amplifier 30 is connected to its inverting input and to the right channel output terminal 32, while its non-inverting input is connected through a level-setting resistor R to a source of potential 39.

Thus, a circuit which is able to control variably a stereo circuit through a full range from a MONO mode through a STEREO mode to a WIDE mode has been described having the features noted.

What is claimed is:

1. A stereo imaging circuit having a first channel and a second channel, comprising:

a first channel input terminal for said first channel, and a second channel input terminal for said second channel;

a first variable resistance and a second variable resistance respectively connected to said first and said second channel input terminals;

a first amplifier in said first channel having an input in circuit with said first variable resistance, an output of said first amplifier in said first channel providing an input to a second amplifier in said first channel, an output of said second amplifier in said first channel providing an output of said first channel to a first channel output terminal;

a first amplifier in said second channel having an input in circuit with said second variable resistance, an output of said first amplifier in said second channel providing an input to a second amplifier in said second channel, an output of said second amplifier in said second channel providing an output of said second channel to a second channel output terminal;

a first interchannel amplifier having a variable transfer ratio related to a third variable resistor and having an input connected to an output of said first left channel amplifier and an output connected to an input of said second right channel amplifier;

a second interchannel amplifier having a variable transfer ratio related to a fourth variable resistor and having an input connected to an output of said first left channel amplifier and an output connected to an input of said second left channel amplifier;

said variable transfer ratio of said first and said second interchannel amplifiers being responsive to said third and said fourth variable resistances, whereby a stereo image circuit is provided which ranges between a MONO mode through a STEREO mode to a WIDE mode, wherein the transfer ratio of each of said first and said second channels is $K_L=K_R=K_1 \cdot K_2(1-K_3)$ where $K_1$ is the transfer ratio Of each of said first and second variable resistances and $K_1 \leqq 1$; $K_2$ is the transfer ratio of each of said first amplifiers in each of said first and said second channels and $1 \leqq K_2$; and $K_3$ is the transfer ratio of each of said first and said second interchannel, and wherein the transfer ratio $K_3$ is $-1 \leqq K_3 < 1$;

wherein at least either said first and third variable resistances or said second and fourth variable resistances are ganged together.

2. The circuit as set forth in claim 1 wherein said first variable resistance and said second variable resistance are ganged together and comprise a potentiometer for controlling said MONO mode and said WIDE mode with said STEREO mode being determined by a variable resistance position along said potentiometer determined by a manual setting.

3. The circuit as set forth in claim 1 wherein said variable transfer ratio of each of said interchannel amplifiers is respectively determined at least in part by said first and said second variable resistances in a feedback relationship between an output and an input of each of said interchannel amplifiers.

4. The circuit as set forth in claim 1 wherein said first and said second variable resistances are respectively connected to a non-inverting input of each of the first amplifiers in each of said first and second channels and connected in circuit between the output and the inverting input of each of said first and said second interchannel amplifiers.

5. The circuit as set forth in claim 1 wherein each of first and said second variable resistances in said first and said second channels is determined by a control potentiometer, said first and said second variable resistances being respectively connected to each of said first and said second interchannel amplifiers to vary their transfer ratios.

6. The circuit as set forth in claim 1 wherein said first and said third variable resistance are determined by a variable resistor in a potentiometer.

7. The circuit as set forth in claim 1 wherein said second and said fourth variable resistance are determined by a variable resistor in a potentiometer.

8. The circuit as set forth in claim 1 wherein said first, second, third, and fourth variable resistances are determined by a variable resistor in a potentiometer.

9. A stereo imaging circuit, comprising:

a potentiometer having a multi-section ganged variable resistance for continuously varying a stereo image from a MONO mode through a STEREO mode to a WIDE mode;

a first channel input terminal, and a second channel input terminal, the variable resistance of said potentiometer being connected in circuit with each of said first and said second channel input terminals;

a first amplifier in said first channel connected in circuit with said variable resistance of said potentiometer, an output of said first amplifier in said first channel providing an input to a second amplifier in said first channel, an output of said second amplifier in said first channel providing an output of said first channel to a first channel output terminal;

a first amplifier in said second channel in circuit with said variable resistance of said potentiometer, an output of said first amplifier in said second channel providing an input to a second amplifier in said second channel, an output of said second amplifier in said second channel providing an output of said second channel to a second channel output terminal;

a first interchannel amplifier having a variable transfer ratio determined at least in part by said variable resistance and having an input connected in circuit with said first channel and an output connected in circuit with said second channel;

a second interchannel amplifier having a variable transfer ratio determined at least in part by said variable resistance and having an input connected in circuit with said second channel and an output connected in circuit with said first channel;

said variable transfer ratio of said first and said second interchannel amplifiers being responsive to said variable resistance of said potentiometer, whereby a stereo image circuit is provided which ranges between a MONO mode through a STEREO mode to a WIDE mode, wherein the transfer ratio of each of said first and said second channels is $K_L = K_R = K_1 \cdot K_2(1 - K_3)$ where $K_1$ is the transfer ratio of said variable resistance of said potentiometer and $K_1 \leqq 1$; $K_2$ is the transfer ratio of each of said first amplifiers in each of said first and said second channels and $1 \leqq K_2$; and $K_3$ is the transfer ratio of each of said first and said second interchannel amplifiers and wherein the transfer ratio of each of the first and the second interchannel amplifiers is $-1 \leqq K_3 < 1$.

10. The circuit as set forth in claim 9 wherein said variable resistance of said potentiometer operates for controlling said MONO mode and said WIDE mode with said STEREO mode being determined by a position along said variable resistance determined by a manual setting.

11. The circuit as set forth in claim 9 wherein said variable resistance of said potentiometer is respectively connected in circuit with each of said first and said second interchannel amplifiers.

12. The circuit as set forth in claim 9 wherein said variable resistance of said potentiometer is connected in circuit with a non-inverting input of each of first amplifiers in each of said first and second channels and is connected in circuit between the output and the inverting input of each of said first and said second interchannel amplifiers.

13. The circuit as set forth in claim 9 wherein said variable transfer ratio of each of said interchannel amplifiers is determined at least in part by said variable resistance potentiometer connected in a feedback relationship between an output and an input of each of said interchannel amplifiers.

* * * * *